US005740491A

United States Patent [19]

Imai

[11] Patent Number: 5,740,491

[45] Date of Patent: Apr. 14, 1998

[54] DEVICE FOR MEASURING LIFE OF A COMPONENT UNIT FOR AN IMAGE FORMING DEVICE

[75] Inventor: Masaaki Imai, Kasugai, Japan

[73] Assignee: Brother Kogyo Kabushiki Kaisha, Nagoya, Japan

[21] Appl. No.: 813,663

[22] Filed: Mar. 7, 1997

[30] Foreign Application Priority Data

Mar. 12, 1996 [JP] Japan ..... 8-054755

[51] Int. Cl.[6] ..... G03G 21/00

[52] U.S. Cl. ..... 399/25

[58] Field of Search ..... 399/25, 26, 24; 377/15, 88

[56] References Cited

U.S. PATENT DOCUMENTS 4,585,327 4/1986 Suzuki ..... 399/26
5,430,780 7/1995 Takeda et al. ..... 377/15

FOREIGN PATENT DOCUMENTS

A-61-83570 4/1986 Japan .
2-3560 1/1990 Japan .
A-4-29159 1/1992 Japan .
5-17728 5/1993 Japan .

*Primary Examiner*—Nestor R. Ramirez
*Attorney, Agent, or Firm*—Oliff & Berridge, P.L.C.

[57] ABSTRACT

A device for measuring life of a process unit, the device including: a process unit detachably mountable in a main unit, the process unit including at least a photosensitive body having a surface on which can be formed a static electric latent image; a counter for measuring life of the process unit; an unused indication sheet provided internally to each unused process unit and discharged from the process unit when an unused process unit is mounted in the main unit; a sensor provided in the main unit, the sensor detecting discharge of each unused indication sheet and outputting an unused indication sheet discharge sensor signal accordingly; and a control unit provided in the main unit and capable of receiving the unused indication sheet discharge sensor signal from the sensor, the control unit resetting the counter upon receipt of the unused indication sheet discharge sensor signal from the sensor.

19 Claims, 8 Drawing Sheets

DEVICE FOR MEASURING LIFE OF A COMPONENT UNIT FOR AN IMAGE FORMING DEVICE

FIELD OF THE INVENTION

The present invention relates to a device for measuring life, such as period of usability, of a component unit in, for example, a piece of office equipment.

DESCRIPTION OF THE RELATED ART

In one type of device for measuring life of a component unit, the accumulative number of times the component is used is measured using a counter. When an old component unit is replaced with a new unused component unit, the counter is reset to zero. An example of a component unit is a processes unit freely mountable to, for example, an electrostatic photographic type image forming device such as a copy machine, a facsimile machine, or a laser printer.

A variety of life measuring devices have been developed for use in this type of image forming device. Here, the case of a device for measuring the life of a process unit provided in a copy machine will be described. The process unit includes: an internal photosensitive body for forming a latent static electric image, a developing unit for developing the latent static electric image with toner, and a transposing portion for transposing the toner image onto a recording medium such as a sheet of paper. The process unit is detachably mountable in the main body of the copy machine.

The example device enables a user to accurately grasp when an old process unit must be replaced with a new process unit. The number of times the process unit is used, that is, the number of times a recording sheet passes through the process unit, is counted using a counter. When the number of the counter exceeds a set number of times, the process unit will have exceeded its life span and must be replaced with a new process unit in order to prevent deterioration of image quality of copies and to maintain quality in images formed on the sheets at an appropriate standard level. Recently, in order to lower the cost of services required to replace the process unit, copy machines have been designed so that the user can replace the process unit by himself or herself.

Once the new process unit has been inserted into the copy machine, since the counter still shows the number of times the old process unit was used, the counter must be reset to zero. On the other hand, if the counter is reset to zero when the process unit presently being used is merely temporarily removed and then remounted into the copy machine during maintenance or repair of the copy machine, then the life of the present process unit can not be accurately measured. Therefore, there is a need to provide a reset prohibiting means for preventing the counter from being reset during such situations.

Japanese Laid-Open Utility Model Application No. HEI-2-3560 describes a reset prohibiting device including a counter and a reset rod for resetting the counter, both provided in the main body of the copy machine. A hole in the upper surface of an unused new process unit is covered by a paper, which serves as a pressing member. When the new unused process unit is mounted into the main body of the copy machine, the reset rod presses against the paper. This action resets the counter. Further pressing of the rod against the paper tears through and forms a hole at a predetermined position in the paper. Therefore, the next time the process unit is removed from and remounted into the copy machine, the reset rod will stick through the hole in the paper so that the counter will not be reset.

Japanese Laid-Open Utility Model Application No. HEI-5-17728 describes a device including a fuse which burns out when energized. The fuse is disposed within the case of a new process unit. A terminal portion connected to both terminals of the fuse is exposed at the outer surface of the case. On the other hand, the main body of the image forming device is provided with a terminal for contacting the terminal portion of the process unit when the process unit is mounted into the image forming device. Additionally, the main body of the image forming device includes: a reset counter circuit, a fuse burn-out determination circuit, and a power circuit. The reset counter circuit is connected with the terminals of the main body.

A new process unit is mounted into the image forming device while the power switch is off. Then, when the power switch is turned on, current flows through the fuse. The fuse burns out in a predetermined short duration of time. The fuse burn-out determination circuit resets the counter upon determining the energization to the fuse and the change in the condition of the fuse caused by the burn out. However, when a process unit with its fuse already burned out is removed from and then remounted into the image forming device, the fuse burn-out determination circuit will not pick up any change in the current flowing to the fuse and so will not reset the counter.

SUMMARY OF THE INVENTION

However, there is a problem with the device described in Japanese Laid-Open Utility Model Application No. HEI-2-3560. That is, because the hole formed in the upper surface of the case is covered by an easily torn sheet of paper, the paper might accidentally be torn when the process unit is handled before being mounted into the image forming device for the first time. Once the paper is torn, it will not reset the counter in the main body of the image forming device. Therefore, this process unit must be handled with extreme care.

There is also a problem with the device described in Japanese Laid-Open Utility Model Application No. HEI-5-17728. That is, components, such as the fuse and the connecting circuitry, must be provided to the case of the process unit, resulting in a complicated configuration of the process unit. To prevent the toner and components of the process unit from being adversely affected by heat from the fuse, the materials and shape of the process unit must be formed taking this heat into consideration so that producing the process unit becomes costly.

It is objective of the present invention to overcome the above-described problems and to provide a device for measuring life of a component unit, such as process unit, wherein the device can be produced inexpensively and is easy to handle.

In order to achieve these objectives, a device according to the present invention is for measuring life of a component unit used in a main unit for processing a sheet transported along a sheet transport pathway of the main unit, and the device includes: a component unit detachably mountable in the main unit so that a sheet transport of the component unit is aligned with the sheet transport pathway of the main unit; a counter provided in the main unit and for measuring life of the component unit; an unused indication sheet disposed in the sheet transport pathway of the component unit; a detection unit disposed in the sheet transport pathway of the main unit and for detecting when the unused indication sheet is discharged from the component unit and passes by the detection unit and when the sheet passes by the detection unit.

According to another aspect of the present invention, a device for measuring life of a process unit includes: a process unit detachably mountable in the main unit and being for processing a sheet, the process unit including at least a photosensitive body having a surface on which can be formed a static electric latent image; a counter for measuring life of the process unit; an unused indication sheet provided internally to each unused process unit, the unused indication sheet having a distinction portion not provided to the sheet; a detection unit provided in the main unit and for detecting passage of the sheet and of the distinction portion of the unused indication sheet at a position downstream from the process unit with respect to a sheet transport pathway; and a control unit provided in the main unit, the control unit resetting the counter when the detection unit detects the distinction portion and detecting sheet jams in the sheet transport pathway based on the detection unit.

According to still another aspect of the invention, a device for measuring life of a process unit includes: a process unit detachably mountable in a main unit, the process unit including at least a photosensitive body having a surface on which can be formed a static electric latent image; a counter for measuring life of the process unit; an unused indication sheet provided internally to each unused process unit and discharged from the process unit when an unused process unit is mounted in the main unit; a sensor provided in the main unit, the sensor detecting discharge of each unused indication sheet and outputting an unused indication sheet discharge sensor signal accordingly; and a control unit provided in the main unit and capable of receiving the unused indication sheet discharge sensor signal from the sensor, the control unit resetting the counter upon receipt of the unused indication sheet discharge sensor signal from the sensor.

BRIEF DESCRIPTION OF THE DRAWINGS

The above and other objects, features and advantages of the invention will become more apparent from reading the following description of the preferred embodiment taken in connection with the accompanying drawings in which:

FIG. 7 (*b*) is a side view showing a condition when the front edge of the unused indication sheet reaches a fixing unit of the laser printer;

FIG. 7 (*c*) is a side view showing a condition when the front edge of the unused indication sheet reaches a discharge sensor of the laser printer;

FIG. 7 (*d*) is a side view showing a condition when the through hole of the unused indication sheet reaches the discharge sensor;

FIG. 7 (*e*) is a side view showing a condition after the through hole of the unused indication sheet passes by the discharge sensor;

FIG. 8 (*b*) is a time chart indicating ON/OFF condition of the discharge sensor as a result of the unused indication sheet passing by the discharge sensor.

DETAILED DESCRIPTION OF THE PREFERRED EMBODIMENTS

Figure 1:
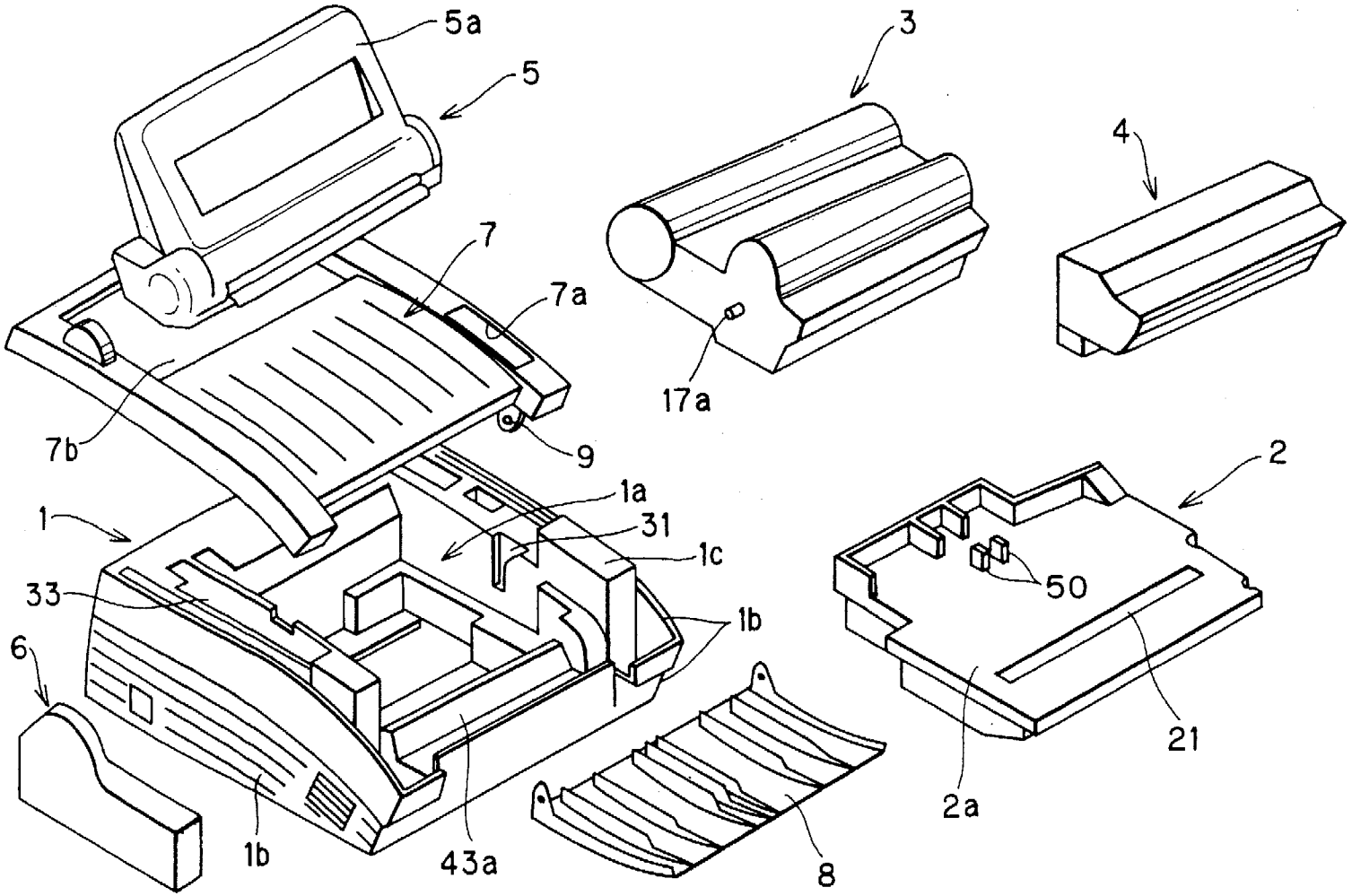
FIG. 1 is a perspective view showing essential portions of a laser printer according to an embodiment of the present invention.
Figure 2:
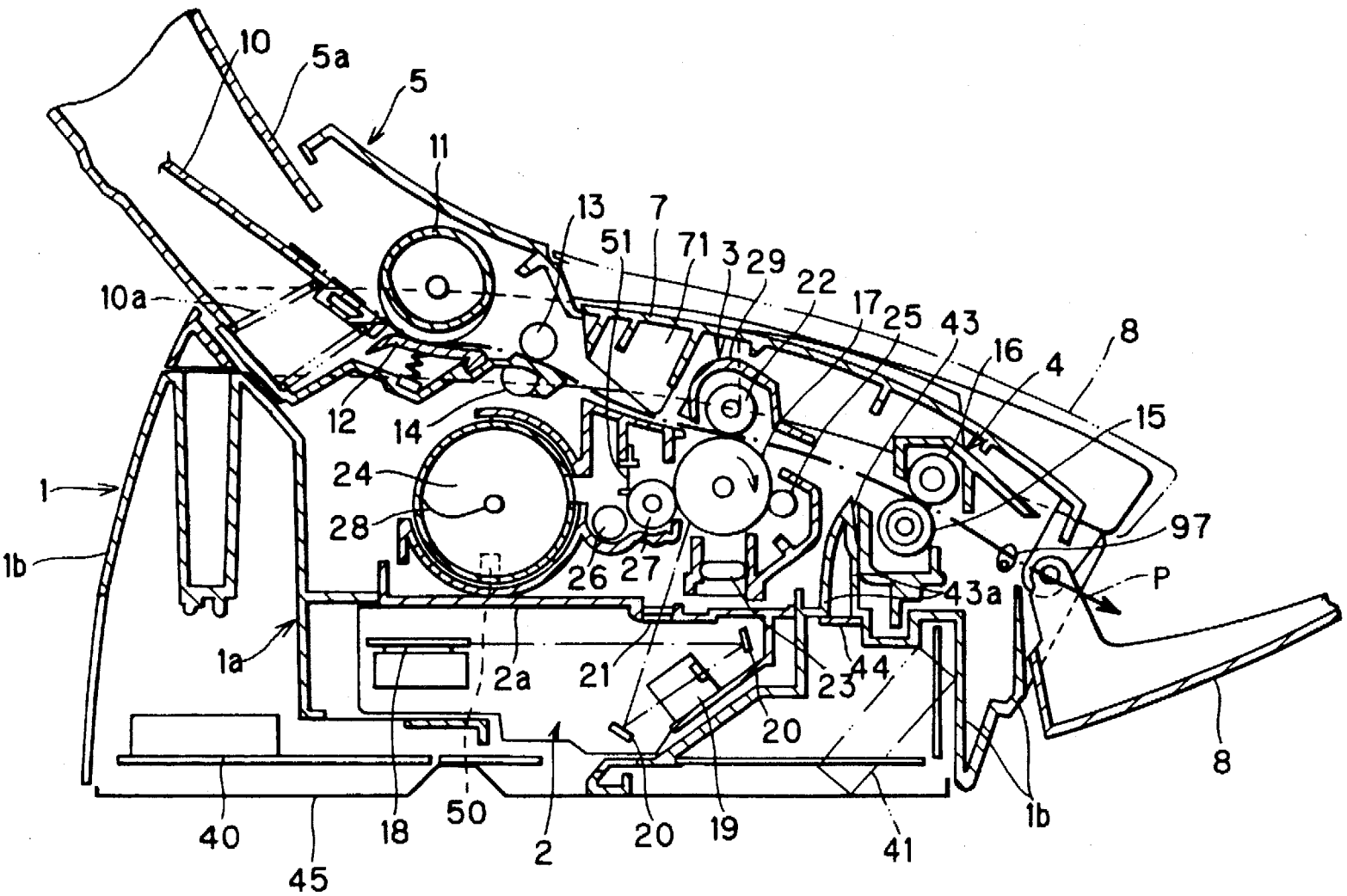
FIG. 2 is a schematic cross-sectional view showing the laser printer.

A device for measuring life of a component unit according to a preferred embodiment of the present invention will be described while referring to the accompanying drawings wherein like parts and components are designated by the same reference numerals to avoid duplicating description. The embodiment describes the present invention applied to a laser beam type printer. FIG. 1 is a perspective view showing essential components of a laser printer serving as an image forming device. FIG. 2 is a schematic cross-sectional view of the laser printer.

As shown in FIG. 1, the main case 1 of the printer includes a compound resin main frame 1*a* and a compound resin main cover body 1*b*. The compound resin main frame 1*a* is for housing a scanner unit 2, a process unit 3, a fixing unit 4, and a sheet-supply unit 5, all mounted from the upper end of the main frame 1*a*. The main cover body 1*b* covers the four side surfaces, that is, the front, rear, left, and right surfaces, of the main frame 1*a*. The main frame 1*a* and the main cover body 1*b* are formed integrally together using injection plastic techniques.

A housing indentation area 33 is formed between the left (as viewed in FIG. 1) inner surface of the main cover body 1*b* and the left side of the main frame 1*a*. A drive system unit 6 including a drive motor and a gear train is inserted from below the main case body 1*b* and fixedly mounted into the housing indentation area 33.

A compound resin top cover 7 is provided for covering the upper surface of the main frame 1*a* and main cover body 1*b*. The top cover 7 is formed with holes 7*a* and 7*b*. An operation panel portion 1*c* protrudes upward through the hole 7*a* at the right side of the main frame 1*a*. The base portion of the sheet-supply unit 5 is inserted into the hole b. Brackets 9, 9 (only one is shown in FIG. 1) are provided in an upright posture to the left and right sides of the front edge of the top cover 7. A base portion of a sheet discharge tray 8 is vertically and pivotably mounted on the brackets 9, 9. When the sheet discharge tray 8 is not being used, it can be folded up to cover the upper surface of the top cover 7.

Next, the operation of the laser printer will be briefly described with reference to FIG. 2. Sheets P are set in a stacked condition in a feeder portion case 5*a* in the sheet-supply unit 5. A support plate 10 having an urging spring 10*a* is provided in the feeder portion case 5*a*. The support plate 10 presses the front edge of the sheet P against a sheet-supply roller 11. In cooperation with the separation pad 12, the sheet-supply roller 11 separates one sheet P at a time from the stack when rotated by drive transmitted from the drive system unit 6. The separated sheet P is fed to a process unit 3 by an upper and lower pair of resist rollers 13, 14. The process unit 3 forms an image from toner on the surface of the sheet P. A thermal roller 15 and a pressing roller 16 of a fixing unit 4 fix the image on the sheet P. Afterward, the sheet P is discharged onto the sheet discharge tray 8.

The main frame 1*a* of the main body case 1 has a box shape with the upper surface open. The process unit 3 is disposed in the substantial center, when viewed from above, of the main frame 1*a*. A resin compound upper support plate 2*a* of the scanner unit 2 is fixed beneath the process unit 3 by a screw and the like to a stay portion formed integrally with the upper surface of the lower plate portion 1*a*-5 of the main frame 1*a*. A laser generating portion, a polygon mirror 18, a lens 19, a reflecting mirror 20, and the like are disposed in the lower side of the upper support plate 2*a* of the scanner unit, which serves as an exposure unit. A horizontally elongated scanner hole is formed in the upper support plate 2*a* so as to extend in the direction following the axial line of a photosensitive drum 17. A glass plate 21 covers the scanner hole. A laser beam passes through the glass plate 21 and exposes the outer peripheral surface of the photosensitive drum 17 in the process unit 3.

As shown in FIG. 2, the process unit 3 includes: the photosensitive drum 17; a transposing roller 22 in abutment with the upper surface of the photosensitive drum 17; a scorotoron charge unit 23 disposed below the photosensitive drum 17; a developing device having a developing roller 27 and a supply roller 23 and disposed upstream from the photosensitive drum 17 in a sheet supply direction; a detachable toner cartridge 24, that is, a developing agent (toner) supply unit, disposed further upstream from the photosensitive drum 17; and a cleaning device 25 disposed downstream from the photosensitive drum 17. The process unit 3 is in cartridge form by the above-described components being assembled in a compound resin case 29. The cartridge process unit 3 is detachably mounted in the main frame 1*a*.

Next, operations of components in the process unit 3 will be briefly described. The charge unit 23 forms a charged layer on the outer peripheral surface of the photosensitive drum 17. The laser beam from the scanner unit 2 scans the outer peripheral surface of the photosensitive drum 17, thereby forming an electrostatic latent image in the charged layer. The developing agent (toner) in the toner cartridge 24 is agitated by an agitating member 28 and released from the toner cartridge 24. The toner is borne on the outer peripheral surface of the developing roller 27 via the supply roller 26 and regulated to a one layer thickness by a blade 51. The electrostatic latent image on the photosensitive drum 17 is developed by developing agent from the developing roller 27 clinging to the electrostatic latent image. The developed image is transposed onto a sheet P passing between the transposing roller 22 and the photosensitive drum 17. Toner remaining on the surface of the photosensitive drum 17 is collected by the cleaning device 25.

An upwardly protruding toner sensor 50 formed from a light generating portion and a light receiving portion is provided to the upper support plate 2*a* of the scanner unit 2. The toner sensor 50 is disposed within an indentation in the lower surface of the toner cartridge 24 in the process unit 3 and detects the presence and absence of toner in the toner cartridge 24.

The toner sensor 50 outputs a signal which also can be used to detect whether the process unit 3 is mounted in or detached from the main frame 1*a*. In another words, when a signal from the toner sensor 50 abruptly switches from a toner present condition to a toner absent condition, and then, after the toner absent condition continues for a predetermined duration of time or longer, the signal from the toner sensor 50 then again abruptly switches to a toner present condition, it can be determined that the process unit was temporality removed and the remounted.

Figure 3:
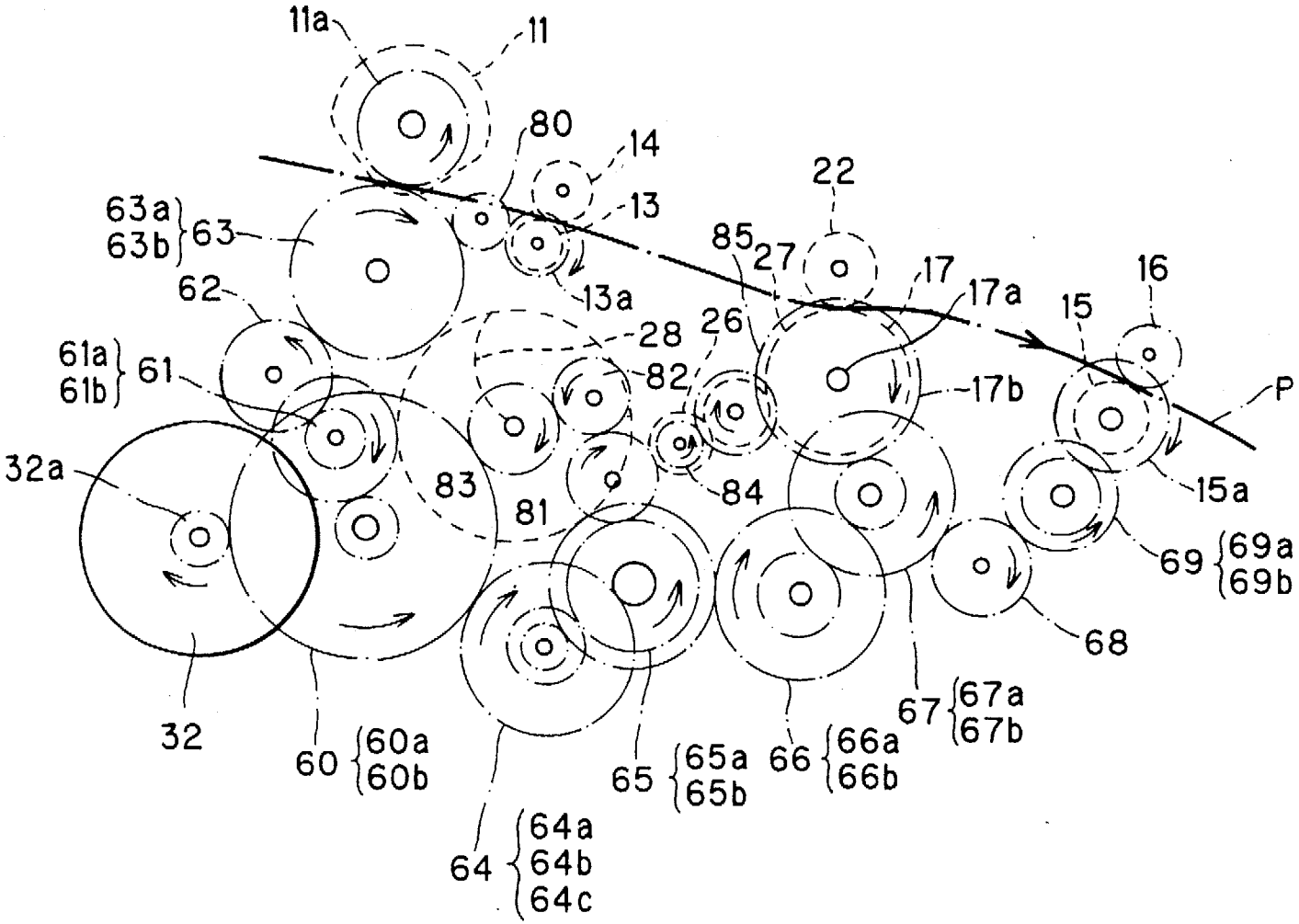
FIG. 3 is a diagram showing a mechanism for transmitting drive force to various units of the laser printer.

FIG. 3 indicates a drive mechanism formed from gear trains for each of the above-described units. A portion of the drive mechanism serves as a drive system unit 6 disposed at one position at the left side of the printer main case 1 as viewed from the front of the printer. A drive motor 32 capable of forward and reverse rotation is fixed to the drive system unit 6. Rotational force of a pinion gear 32*a* of the drive motor 32 is transmitted to a gear 62 and then a two speed gear 63 (63*a*, 63*b*) via a two speed gear 60 (60*a*, 60B) and a two speed gear 61 (61*a*, 61*b*). Rotational force is then transmitted to a gear 11*a* for driving the sheet supply roller 11 of the sheet-supply unit 5. Rotational force of the gear 63 is transmitted to a gear 13*a* of the resist roller 13 via a transmission gear 80.

Rotational force of the two speed gear 60 (60*a*, 60*b*) is transmitted to a gear 17*b* of the photosensitive drum 17 via a three speed gear 64 (64*a*, 64*b*, 64*c*), a two speed gear 65 (65*a*, 65*b*), a two speed gear 66 (66*a*, 66*b*), and a two speed gear 67 (67*a*, 67*b*). Further, rotational force of the two speed gear 67 (67*a*, 67*b*) is transmitted to a gear 15*a* of the thermal roller 15 in the fixing unit 4 via a gear 68 and a two speed gear 69 (69*a*, 69*b*).

On the other hand, rotational force of a two speed gear 65 (65*a*, 65*b*) is transmitted to the agitation member 28 via gears 81, 82, and 83, and also transmitted to the developing roller 27 and the supply roller 26 via gears 81, 84, and 85. It should be noted that the drive motor 32 and the pinion gear 32*a*, the two speed gears 60, 61, 63, 65, 66, 67 ,69, and the three speed gears 64, 62, 68, are assembled in the compound resin frame of the drive system unit 6.

Figure 4:
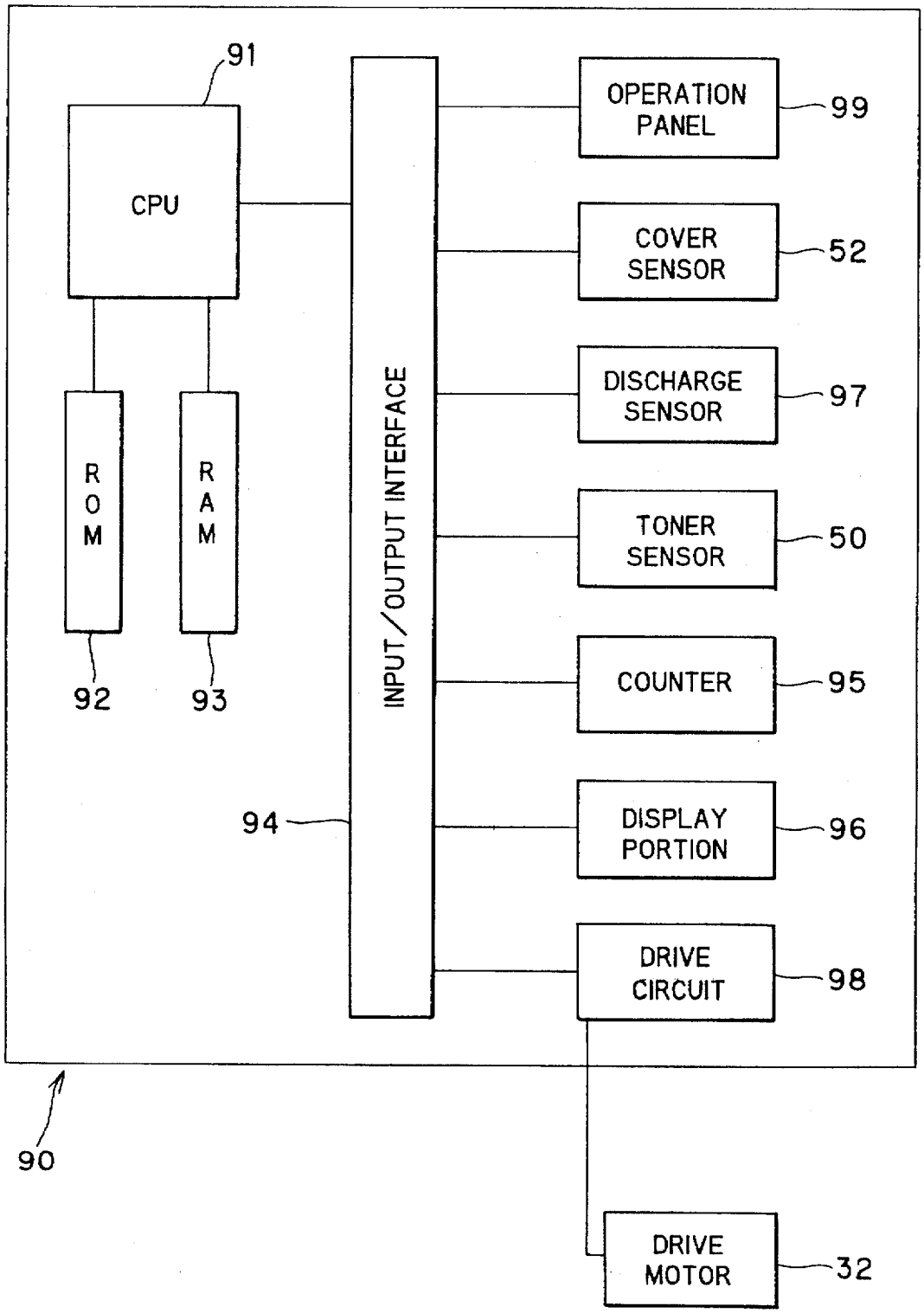
FIG. 4 is a block diagram showing a control unit of the laser printer.
Figure 5:
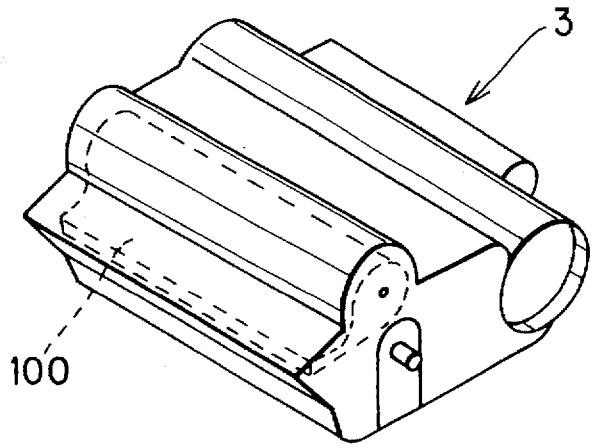
FIG. 5 is a perspective view showing a new unused process unit and an unused indication sheet preinserted in the process unit.

Next, an explanation will be provided for the life measuring device of the process unit 3, which serves as a component unit, while referring to FIGS. 2 and 4 through 7. FIG. 4 is a block diagram for a control unit 90 including the life measuring device of the process unit 3. The control unit 90 includes: a central processing unit (CPU) 91, such as a microcomputer, for executing control processes such as computations; a ROM 92 storing control programs; a RAM 93 storing variety of data; and an input/output interface 94. A variety of components are connected to the input/output interface 64, for example: a counter 94 for measuring life of the process unit; a display device 96 such as an LCD for advising when to replace the process unit 3; a sheet discharge sensor 97 to be described later; the toner sensor 50; a cover sensor 52 for detecting when the top cover 7 is opened and closed; a drive circuit 98 for driving the drive motor 32 of the process unit 3 and the like; and an operation panel 99.

The life of the process unit 3 is generally determined by the number of the times it is used. In the present embodiment, each one time the process unit 3 is used to form an image, the photosensitive drum 17 must be rotated a predetermined number of times. When the accumulated number of times the photosensitive drum 17 is rotated reaches a predetermined number or greater, then the image forming performance of the photosensitive drum 17 will deteriorate. Taking this into account each time the photosensitive drum 17 rotates a preset number of times, the counter 95 is incremented by one. When the number value of the counter 95 reaches predetermined value, then a message informing the user that the process unit 3 needs to be replaced will be displayed on the display device 96. It should be noted that the number of times the photosensitive drum 17 rotates can be determined by the number of drive pulses supplied to the drive motor 92.

Alternatively, the life of the process unit 3 can be measured by using the counter 95 to count the number of sheets P passing through the transport pathway. In a photocopy machine, the life of the process unit 3 can be measured by counting each single reciprocal run of the document support. It should be noted that in the present embodiment the counter 95 is incorporated into a nonvolatile memory (not shown in drawings) and so that the number of the counter 95 can be maintained without being erased even if power of the printer is turned off.

Figure 6:
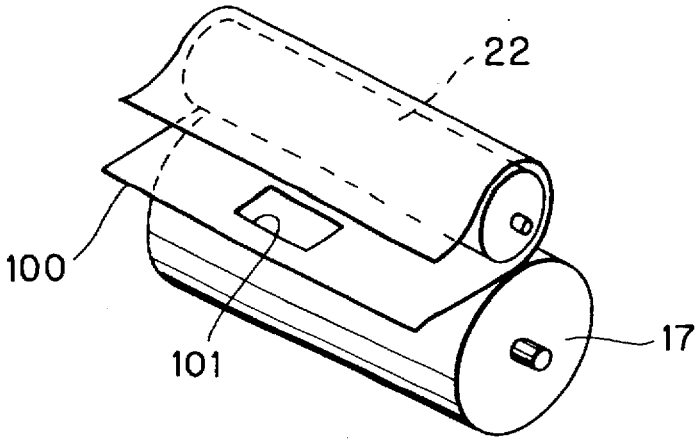
FIG. 6 is a perspective view showing disposition of the unused indication sheet in the process unit and a through hole opened in the unused indication sheet.
Figure 7A:
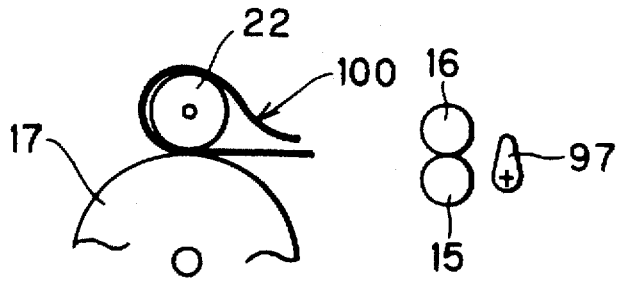
FIG. 7 (*a*) is a side view showing a condition directly after a new process unit is mounted.
Figure 7B:
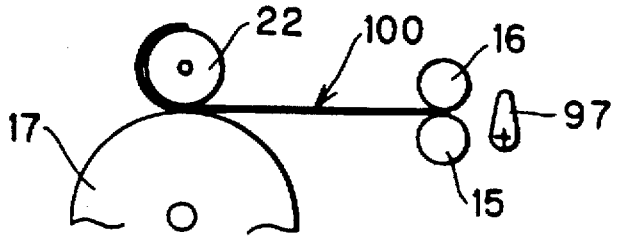
Figure 7C:
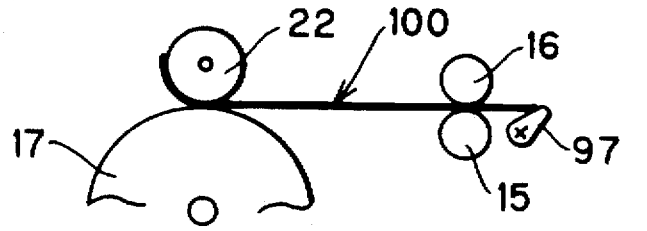
Figure 7D:
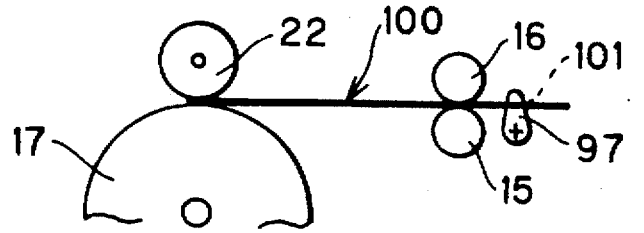
Figure 7E:
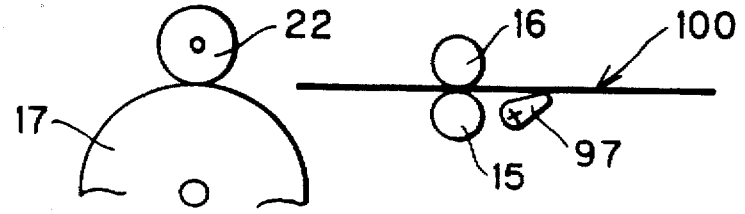

Next an explanation will be provided for operations, according to the present embodiment, for distinguishing between a normal sheet and an unused indication sheet 100 of the process unit 3 and for resetting the counter 95 to zero accordingly when an unused process unit 3 is mounted. As shown in FIG. 2, an entrance port and an exit port are provided in the upper side of the compound resin case 29 of the process unit 3 so that the sheet P passes between the photosensitive drum 17, which is to disposed the interior of the case 29, and the transposing roller 22, which is disposed so as to abut the photosensitive drum 17. The unused indication sheet 100 is formed from a compound resin or from paper and is pre-inserted between the photosensitive drum 17 and the transposing roller 22 where the two abut together. As shown in FIG. 6, a passage hole 101 is formed near the front edge of the unused indication sheet 100.

On the other hand, the sheet discharge sensor 97 for distinguishing between the sheet P and the unused indication sheet 100 in the transport pathway of the sheet P is provided downstream from the process unit 3 with respect to the transport pathway. In this example, the sheet discharge sensor 97 is disposed downstream of the fixing unit 4. The sheet discharge sensor 97 is constantly urged to intersect with the transport pathway of the sheet P. A limit switch (not shown in drawings) is provided to operate in connection with the sheet discharge sensor 97. When the sheet discharge sensor 97 intersects the transport pathway of the sheet P, then the limit switch will output an OFF detection signal. When a transported sheet P (or an unused indication sheet 100) contacts the sheet discharge sensor 97, then the sheet discharge sensor 97 pivots over in the downstream direction of the transport pathway so that the limit switch (not shown in drawings) will output an ON signal.

Figure 8A:
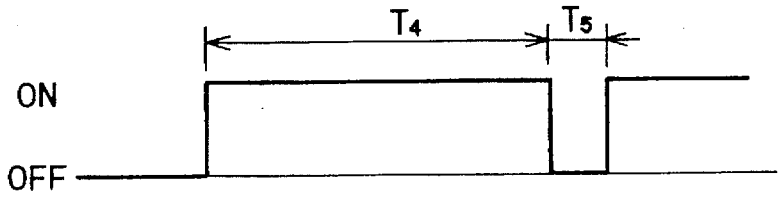
FIG. 8 (*a*) is a time chart indicating ON/OFF condition of the discharge sensor as a result of a recording sheet passing by the discharge sensor.
Figure 8B:
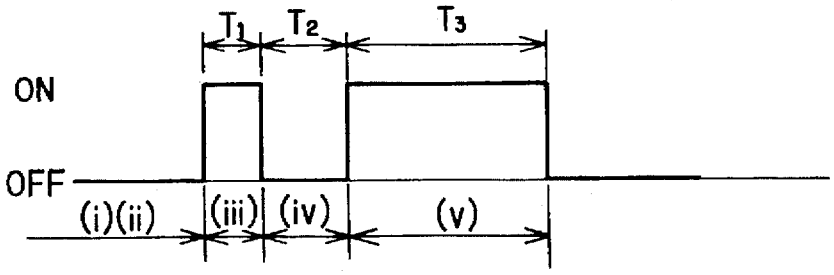

With this configuration, when an new unused process unit 3 is mounted in its predetermined position of the main case 1 and the drive motor 32 is driven to rotate, then the posture of the sheet discharge sensor 97 will change in the manner shown in FIGS. 7(*a*) to 7(*e*). The ON and OFF timing of the signal outputted by the sheet discharge sensor 97 will change accordingly as shown in FIG. 8(*b*). It should be noted that notations (i) through (v) in FIG. 8(*b*) correspond to situations shown in FIGS. 7(*a*) to 7(*e*) respectively.

When, as shown in FIG. 7(*a*), the process unit 3 is first mounted so that the unused indication sheet 100 is still set in the process unit 3, then the discharge sheet sensor 97, which is downstream in the transport pathway from the process unit 3, will be disposed in an upright posture. Next, the drive motor 32 is driven so that the photosensitive drum 17 and the transposing roller 22 rotate in a predetermined direction for feeding the unused indication sheet 100 toward the fixing unit 5. When, as shown in FIG. 7(*b*), the edge of the unused indication sheet 100 reaches the thermal roller 15 and a pressing roller 16, but does not yet contact the sheet discharge sensor 97, then the sheet discharge sensor 97 will remain disposed in an upright posture. The ON/OFF condition of the sheet discharge sensor 97 corresponding to this condition is OFF as shown in FIG. 8(*b*).

When the front edge of the unused indication sheet 100 contacts the sheet discharge sensor 97 as shown in FIG. 7(*c*), the sheet discharge sensor 97 pivots toward the downstream side of the transport pathway into a reclining posture. The resultant ON signal from the sheet discharge sensor 97 lasts for a duration of time T1, which is a duration of time required for the distance from the front edge of the unused indication sheet 100 to the front edge of the through hole 101 to pass by the position of the discharge sensor 96.

As the unused indication sheet 100 proceeds, the through hole 101 will reach the position of the sheet discharge sensor 97. The sheet discharge sensor 97 will pivot into the through hole 101 and back into its upright posture as shown in FIG. 7(*d*). As a result, the sheet discharge sensor 97 will output an OFF signal. The off signal will continue for a duration of time T2, which is the time required for the through hole 101 to pass by the sheet discharge sensor 97 when the unused indication sheet 100 follows the sheet transport direction. When the through hole 101 passes by the sheet discharge sensor 97, the sheet discharge sensor 97 will abut the center part of the unused indication sheet 100 and again pivot into a reclining posture as shown in FIG. 7(*e*). As a result, the sheet discharge sensor 97 will output an ON signal for a duration of time T3, which is the time required until the rear edge of the unused indication sheet 100 passes by the location of the sheet discharge sensor 97. Afterward, the sheet discharge sensor 97 will again pivot into an upright posture so that an ON signal is outputted. The output signal from the sheet discharge sensor 97 will OFF until the front edge of the first sheet P, on which an image is to be formed, abuts the sheet discharge sensor 97, whereupon the output signal from the sheet discharge sensor 97 will again revert to an ON status.

On the other hand, when normal sheets P pass by the location of the sheet discharge sensor 97 at a predetermined spacing, then as shown in FIG. 8(*a*) the output signal from the sheet discharge sensor 97 will revert to ON for a duration of time T4, which is the time required for the entire sheet P, from its front edge to its rear edge, to pass by the sheet discharge sensor 97. The output signal from the sheet discharge sensor 97 then reverts to an OFF signal for a duration of time T5, which is the time for the front edge of the next sheet P to abut against the sheet discharge sensor 97.

In this way, two ON/OFF patterns can be discerned: one shown in FIG. 8(*a*) for when the normal sheet P passes by the location of the sheet discharge sensor 97 and one shown in FIG. 8(*b*) for when the unused indication sheet 100 passes by the sheet discharge sensor 97. The time pattern shown in FIG. 8(*b*), which includes time durations T1, T2, T3, is prestored in the ROM 92 or the RAM 93. When the time pattern including time durations T1, T2, and T3 is detected, the CPU 91 will know that the process unit 3 is a new unused process unit and so will reset the counter 95 to zero.

Afterward when the process unit 3 is operated, the counter 95 will be incremented by one each time the photosensitive drum 17 rotates a predetermined number of times. Therefore, when the process unit 3, which has had its unused indication sheet 100 discharged, is removed from the body case 1 for periodical maintenance, repair, and the like and then remounted into the body case 1, the counter 95 will only be incremented when the sheet P passes thereby. That is to say, because the CPU 91 does not detect the ON and OFF pattern shown in FIG. 8(*b*), the counter 95 will not be reset to zero.

Figure 9:
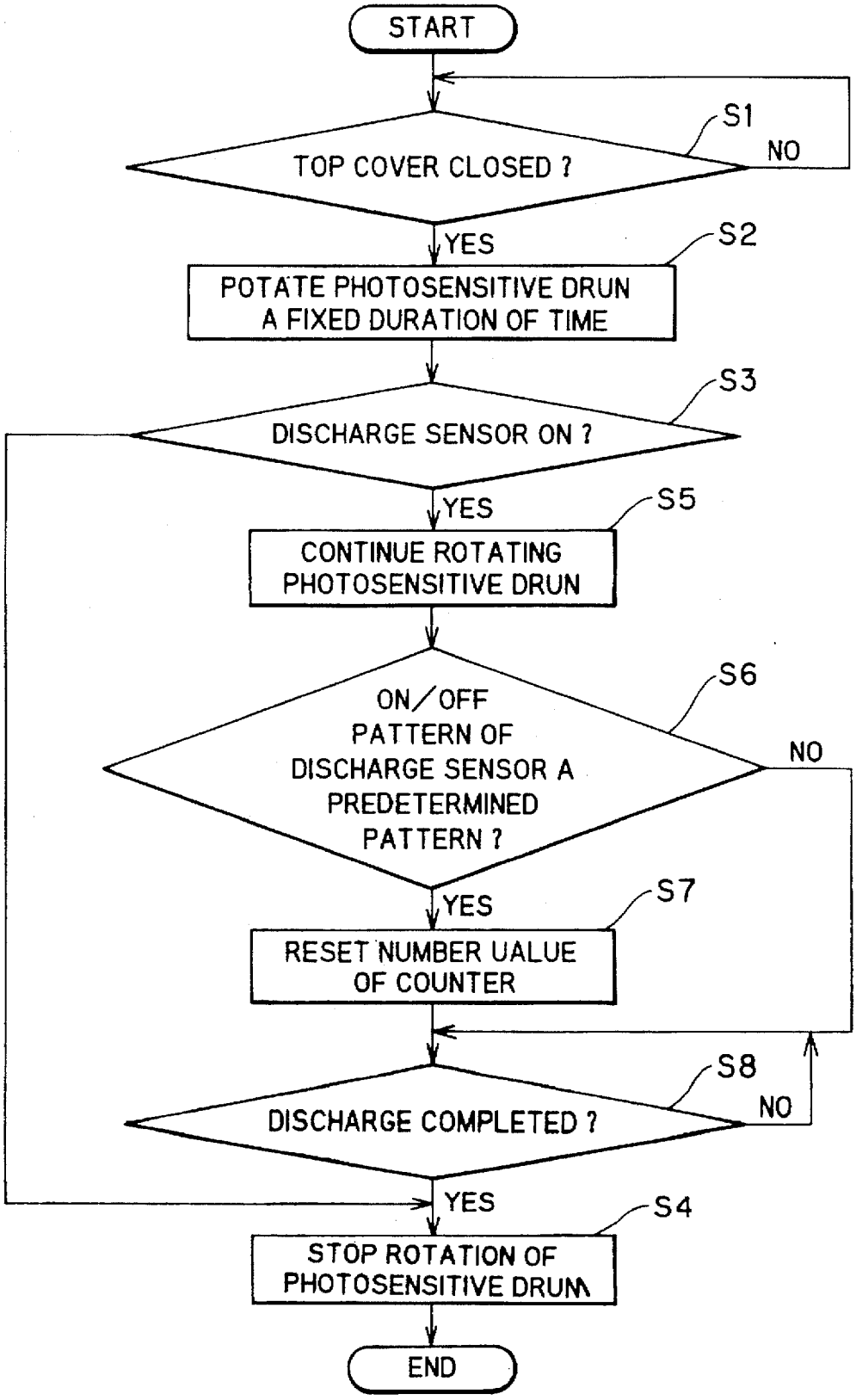
FIG. 9 is a flowchart representing control operations for resetting a counter in association with replacement of an old process unit with a new one and counting operations thereafter.

FIG. 9 is a flowchart representing control operations for resetting the counter 95 and for counting rotation of the photosensitive drum 17 accompanying replacement of an old process unit 3 with a new one. So that the processes represented by the flowchart will be performed whenever the process unit 3 is replaced, either while the power is OFF or while the power is ON, operations in the flowchart are performed by the CPU 91 whenever the power of the printer is turned ON and also when, based on an output signal from the toner sensor 50, the CPU 91 detects that a process unit 3 has been removed and then remounted in the printer.

That is, when the user opens the printer top cover 7, removes the process unit 3 from the body case 1, and mounts a next new process unit 3 into the body case 1 while the power is ON, the CPU 91 performs the following processes after determining, based on the output signal from the toner sensor 51, that the process unit 3 was replaced. On the other hand, when the process unit 3 is replaced while the power is OFF, the CPU 91 performs the following processes whenever the power is again turned ON.

First, in step 1, based on the output signal from the cover sensor 52, the CPU 91 determines whether or not the top cover 7 is closed. If so (step 1:YES), then in step 2 the CPU 91 drives the drive motor 32 a predetermined duration of time required to rotate the photosensitive drum 17 by a fixed number of rotations so that the unused indication sheet 100 to reach the sheet discharge sensor 97.

Next, whether or not the sheet discharge sensor 97 is ON is determined in step 3. If the sheet discharge sensor 97 is OFF (step 3:NO)photon in step 4, rotation of the photosensitive drum 17 is stopped because no sheet P or unused indication sheet 100 was sandwiched between the photosensitive drum 17 and the transposing roller 22 and so was not discharged from the fixing unit 5. On the other hand, if the sheet discharge sensor 97 turns ON (step 3:YES), then it is determined that a sheet P or an unused indication sheet 100 was sandwiched between the photosensitive drum 17 and the transposing roller 22 and that its front edge has reached the sheet discharge sensor 97. Therefore, rotation of the photosensitive drum 17 is continued in step 5 to further discharge the sheet P or the unused indication sheet 100 from the fixing unit 5.

Next, in step 6 whether or not the ON and OFF pattern outputted from the sheet discharge sensor 97 is the predetermined pattern shown in FIG. 8(*b*) is determined. If so (step 6:YES), then the CPU 91 determines that the unused indication sheet 100 has passed by the sheet discharge sensor 97 and the process unit 3 is an unused and newly mounted one. Therefore, in step 7 the CPU 91 resets the counter value of the counter 91 to zero. In this way, the counter value of the counter 91 for measuring life of the process unit 3 can be automatically returned to its initial value of zero. Next, whether or not the unused indication sheet 100 presently in the sheet transport pathway has been completely discharged or not is determined in step 8. After the unused indication sheet 100 has been completely discharged by rotation of the photosensitive drum 17 (step 8:YES), then rotation of the photosensitive drum 17 is stopped in step 4.

On the other hand, when it is determined that the output pattern from the discharge sensor 97 is not the predetermined pattern shown in FIG. 8(*b*) (step 6:NO), then the CPU 91 determines that the mounted process unit 3 is one that was remounted during maintenance or repair while a sheet P remained in the sheet transport pathway. In this case, because it is necessary to continue counting using the counter 95, the counter 95 is not reset to zero. After the sheet P has been completely discharged by rotation of the photosensitive drum 17 (step 8:YES), then rotation of the photosensitive drum 17 is stopped in step 4.

While the invention has been described in detail with reference to specific embodiments thereof, it would be apparent to those skilled in the art that various changes and modifications may be made therein without departing from the spirit of the invention, the scope of which is defined by the attached claims.

For example, instead of the sheet discharge sensor 97 of the embodiment, detection of whether a sheet passing through the sheet transport pathway is a sheet P or an unused indication sheet 100 can be performed using a light reflecting type sensor disposed downstream in the transport direction from the fixing unit 5. In this case, an identification mark, such as a bar code, could be provided on the surface of the unused indication sheet 100 at a portion near the front edge. When an unused indication sheet 100 passes by the light reflecting type sensor, the counter 95 can be reset when the identification mark is detected.

In the above-described embodiment an unused indication sheet 100 is preinserted at a position between the photosensitive drum 17 and the transpose roller 22 where these two abut each other. With this configuration, abutment between the surface of the photosensitive drum 17 and the transpose portion can be prevented. Therefore, the photosensitive drum 17 of a new unused process unit 3 will not be damaged even if the process unit 3 is vibrated during transport or storage after manufacture.

However, no transposing portion such as the transposing roller 22 need be provided in the process unit. A sheet prestored in the process unit for protecting the outer surface of the unused photosensitive drum can serve as the unused indication sheet having an identification portion such an identification mark or a through hole for distinguishing it from a sheet P. In this case also, then the unused new process unit is mounted into the body case, the unused indication sheet is discharged from the process unit by a predetermined operation. A device can be provided to reset the count number of the counter for measuring life of the process unit when discharge of the unused indication sheet is detected by a sensor and the like provided to the main case. With this configuration also, until discharge of unused indication sheet is detected, the count number of the counter will not be reset merely by a sheet P passing by the sensor.

Also, when as described in the preceding paragraph, no transposing portion such as the transposing roller 22 is provided in the process unit and a sheet prestored in the process unit serves as the unused indication sheet, then the unused indication sheet can be discharged in a downstream direction of the transport direction for the sheet P by a predetermined operation when the unused new process unit is mounted into the body case. Whether or not a sheet P or an unused indication sheet is passing by can be detected by merely a single detection means provided further downstream in the transport direction from the process unit of the body case. A reset unit can be provided to reset the count number of the counter for measuring the life of the process unit when the detection unit detects passage of the unused indication sheet.

With this configuration, when a single detection means is used to detect whether the sheet P or the unused indication sheet is passing thereby, then the same detection unit can be used to detect both paper jams by detecting whether or not the sheet P passes thereby and also to reset the counter by detecting whether or not an unused process unit was mounted. Therefore, costs for producing the printer can be reduced.

When the component unit mounted in the main body is an unused one, then the sensor, or other determination unit provided in the sheet transport pathway, determines that the unused indication sheet pre-inserted in the component unit at a position where print sheets will pass is not a print sheet. When the component unit is one presently being used, then the sensor will detect only passage of the sheets.

Accordingly, when print sheets pass by the sensor, the counter for measuring life of component unit is operated. When an unused indication sheet passes by the sensor, then the counter is reset. Therefore, the count number of the counter is restarted in association with mounting of a new component unit so that the life of the component unit is accurately measured. Because the unused indication sheet is pre-inserted in the sheet passage location in the component unit, the unused indication sheet can also serve as a protection sheet, disposed at the passage location of a new component unit. Therefore, the unused new component unit can be protected from damage during transport and storage.

When a through hole is opened to a suitable size in the unused indication sheet, then a variety of sensors, for example, contact type sensors or optical type sensors capable of distinguishing between blocking and transmission of light, can be used to detect the difference between the unused indication sheet and normal print sheets. Whether or not the sheet passing by is a print sheet or unused indication sheet can be easily determined using such sensors. When the unused indication sheet is provided with an identification mark such as bar code, then a sensor such as a reflection type sensor can be used to also easily determine whether the passing sheet is a print sheet or an unused indication sheet.

The process unit used in an image forming device such as a printer or copier needs to be replaced when life expires as determined based on the number of times it is used. According to the present invention applied to such a device, when an old process unit is replaced with a new unused one, then the count number of the counter can be reset when the old process unit is replaced with the new one so that the measurement of life of the new process unit can be accurately and automatically started. By pre-inserting the unused indication sheet at a position where the transposing potions and the photosensitive drum abut against each other, the surface of the photosensitive drum can be protected at the abutment portion.

When a toner sensor or other unit is provided for detecting presence of the process unit in the main unit, then each time after power of the main unit is turned from an off condition to an on condition, then the photosensitive drum is driven an amount needed to discharge the unused indication sheet from process unit. With this configuration, regardless of whether the process unit is replaced when the power is OFF or the power is ON, because the presence or absence of the unused indication sheet is determined, then whether or not the replaced process unit is a new unused unit or not can be determined so that the user will accurately know when to replace a used component unit with a new one.

What is claimed is:

1. A device for measuring life of a component unit used in a main unit for processing a sheet transported along a sheet transport pathway of the main unit, the device comprising:

a component unit detachably mountable in the main unit so that a sheet transport of the component unit is aligned with the sheet transport pathway of the main unit;

a counter provided in the main unit and for measuring life of the component unit;

an unused indication sheet disposed in the sheet transport pathway of the component unit;

a detection unit disposed in the sheet transport pathway of the main unit and for detecting when the unused indication sheet is discharged from the component unit and passes by the detection unit and when the sheet passes by the detection unit.

2. A device as claimed in claim 1, wherein the unused indication sheet has a through hole, the detection unit using the through hole to detect a first time relating to passage of the unused indication sheet by the detection unit and a second time relating to passage of the sheet by the detection unit, the first time being different from the second time.

3. A device as claimed in claim 2, wherein the component unit is a process unit including:

a photosensitive body having a surface on which can be formed an electrostatic latent image;

a developing unit for forming a toner image on the photosensitive body; and a transposing portion for transposing the toner image onto a sheet passing between the transposing portion and the developing portion; and wherein, in an unused process unit, the unused indication sheet is preinserted between the photosensitive body and the transposing portion.

4. A device as claimed in claim 1, wherein the unused indication sheet has a distinction mark, the detection unit using the distinction mark to detect that the unused indication sheet is not the sheet.

5. A device as claimed in claim 4, wherein the component unit is a process unit including:

a photosensitive body having a surface on which can be formed an electrostatic latent image;

a developing unit for forming a toner image on the photosensitive body; and a transposing portion for transposing the toner image onto a sheet passing between the transposing portion and the developing portion; and wherein, in an unused process unit, the unused indication sheet is preinserted between the photosensitive body and the transposing portion.

6. A device as claimed in claim 1, wherein the component unit is a process unit including:

a photosensitive body having a surface on which can be formed an electrostatic latent image;

a developing unit for forming a toner image on the photosensitive body; and a transposing portion for transposing the toner image onto a sheet passing between the transposing portion and the developing portion; and wherein, in an unused process unit, the unused indication sheet is preinserted between the photosensitive body and the transposing portion.

7. A device as claimed in claim 1, wherein the component unit is a process unit detachably mountable in the main unit, the process unit including at least a photosensitive body having a surface on which can be formed a static electric latent image.

8. A device as claimed in 7, wherein:

the unused indication sheet is discharged from the process unit when the process unit is unused and newly mounted into the main unit; and the detection unit is a sensor, the sensor outputting an unused indication sheet discharge sensor signal according to detection of discharge of an unused indication sheet; and further comprising:

a control unit provided in the main unit and capable of receiving the unused indication sheet discharge sensor signal from the sensor, the control unit resetting the counter upon receipt of the unused indication sheet discharge sensor signal from the sensor.

9. A device as claimed in claim 8, wherein the unused indication sheet has a through hole, the detection unit using the through hole to detect a first time relating to passage of the unused indication sheet by the detection unit and a second time relating to passage of the sheet by the detection unit, the first time being different from the second time.

10. A device as claimed in claim 9, wherein the process unit includes:

a developing unit for forming a toner image on the photosensitive body; and a transposing portion for transposing the toner image onto a sheet passing between the transposing portion and the developing portion; and wherein, in an unused process unit, the unused indication sheet is preinserted between the photosensitive body and the transposing portion.

11. A device as claimed in claim 7, wherein:

the unused indication sheet has a distinction portion not provided to the sheet; and the detection unit is disposed at a position downstream from the process unit with respect to the sheet transport pathway; and further comprising:

a control unit provided in the main unit, the control unit resetting the counter when the detection unit detects the distinction portion and detecting sheet jams in the sheet transport pathway based on the detection unit.

12. A device as claimed in claim 11, wherein the distinction portion of the unused indication sheet is a through hole opened in the unused indication sheet, the detection unit using the through hole to detect a first time relating to passage of the unused indication sheet by the detection unit and a second time relating to passage of the sheet by the detection unit, the first time being different from the second time.

13. A device as claimed in claim 12, wherein the process unit includes:

a developing unit for forming a toner image on the photosensitive body; and a transposing portion for transposing the toner image onto a sheet passing between the transposing portion and the developing portion; and wherein, in an unused process unit, the unused indication sheet is preinserted between the photosensitive body and the transposing portion.

14. A device for measuring life of a process unit, the device comprising:

a process unit detachably mountable in a main unit, the process unit including at least a photosensitive body having a surface on which can be formed a static electric latent image;

a counter for measuring life of the process unit;

an unused indication sheet provided internally to each unused process unit and discharged from the process unit when an unused process unit is mounted in the main unit;

a sensor provided in the main unit, the sensor detecting discharge of each unused indication sheet and outputting an unused indication sheet discharge sensor signal accordingly; and a control unit provided in the main unit and capable of receiving the unused indication sheet discharge sensor signal from the sensor, the control unit resetting the counter upon receipt of the unused indication sheet discharge sensor signal from the sensor.

15. A device as claimed in claim 14, wherein the process unit further includes a transposing roller in confrontation with the photosensitive body, the unused indication sheet being disposed between the transposing roller and the photosensitive body.

16. A device as claimed in claim 15, further comprising:

a process unit presence detection unit for detecting presence of a process unit in the main unit; and a control unit for driving one of the photosensitive drum and the transposing roller only an amount needed to discharge the unused indication sheet from the process unit when, after power of the main unit is turned from an off condition to an on condition, the process unit presence detection unit detects presence of a process unit.

17. A device for measuring life of a process unit used in a main unit, the device comprising:

a process unit detachably mountable in the main unit and being for processing a sheet, the process unit including at least a photosensitive body having a surface on which can be formed a static electric latent image;

a counter for measuring life of the process unit;

an unused indication sheet provided internally to each unused process unit, the unused indication sheet having a distinction portion not provided to the sheet;

a detection unit provided in the main unit and for detecting passage of the sheet and of the distinction portion of the unused indication sheet at a position downstream from the process unit with respect to a sheet transport pathway; and a control unit provided in the main unit, the control unit resetting the counter when the detection unit detects the distinction portion and detecting sheet jams in the sheet transport pathway based on the detection unit.

18. A device as claimed in claim 17, wherein the process unit further includes a transposing roller in confrontation with the photosensitive body, the unused indication sheet being disposed between the transposing roller and the photosensitive body.

19. A device as claimed in claim 18, further comprising:

a process unit presence detection unit for detecting presence of a process unit in the main unit; and a control unit for driving one of the photosensitive drum and the transposing roller only an amount needed to discharge the unused indication sheet from the process unit when, after power of the main unit is turned from an off condition to an on condition, the process unit presence detection unit detects presence of a process unit.

* * * * *